US008410701B2

(12) United States Patent
Lee et al.

(10) Patent No.: US 8,410,701 B2
(45) Date of Patent: Apr. 2, 2013

(54) ILLUMINATION APPARATUS HAVING AN ADAPTER WITH A MEMORY FOR STORING DRIVING PULSE INFORMATION

(75) Inventors: Young Hwan Lee, Seoul (KR); Kwan Soo Jang, Seoul (KR); Chung Hyun Cho, Goyang-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 390 days.

(21) Appl. No.: 12/615,125

(22) Filed: Nov. 9, 2009

(65) Prior Publication Data

US 2010/0117550 A1 May 13, 2010

Related U.S. Application Data

(60) Provisional application No. 61/113,535, filed on Nov. 11, 2008, provisional application No. 61/113,525, filed on Nov. 11, 2008.

(30) Foreign Application Priority Data

Nov. 11, 2008 (KR) ..... 10-2008-0111910

(51) Int. Cl.
*H01J 7/44* (2006.01)

(52) U.S. Cl. ..... 315/51; 362/249.02; 439/620.01

(58) Field of Classification Search ..... 315/51, 315/72, 200 R, 209 R, 246, 287, 294, 291, 315/307; 439/236, 620.01, 620.02; 362/227, 362/249.01, 249.02, 249.05, 249.06, 249.14
See application file for complete search history.

(56) References Cited

U.S. PATENT DOCUMENTS

| | | | | |
|---|---|---|---|---|
| 5,442,258 | A * | 8/1995 | Shibata | 315/129 |
| 5,759,054 | A * | 6/1998 | Spadafore | 439/236 |
| 5,924,784 | A * | 7/1999 | Chliwnyj et al. | 362/234 |
| 7,932,679 | B2 * | 4/2011 | Ball | 315/247 |
| 8,035,307 | B2 * | 10/2011 | Chew | 315/200 R |
| 2004/0066142 | A1 * | 4/2004 | Stimac et al. | 315/50 |

* cited by examiner

*Primary Examiner* — Thuy Vinh Tran
(74) *Attorney, Agent, or Firm* — The Law Offices of Andrew D. Fortney; Andrew D. Fortney

(57) ABSTRACT

An illumination apparatus can include an adapter that converts alternating power into driving power, and controls one or more of the color, brightness, chroma, and blinking of a light emitting device; and a light emitting device illumination part detachably and electrically connected to the adapter, containing one or more light emitting devices configured to emit light in accordance with the driving power and control.

12 Claims, 9 Drawing Sheets

ILLUMINATION APPARATUS HAVING AN ADAPTER WITH A MEMORY FOR STORING DRIVING PULSE INFORMATION

The present application claims priority to Korean Patent Application Nos. 10-2008-0111906 (filed on Nov. 11, 2008) and 10-2008-0111910 (filed on Nov. 11, 2008) under 35 U.S.C. §119(a)-(d), and U.S. Provisional Application Nos. 61/113,535 (filed on Nov. 11, 2008) and 61/113,525 (filed on Nov. 11, 2008) under 35 U.S.C. §119(e), which are hereby incorporated by reference in their entirety.

BACKGROUND

Description of the Related Art

Embodiments of the invention relate to an illumination apparatus.

At the present time, a fluorescent lamp or an incandescent lamp has been widely used as an illumination apparatus. In particular, the fluorescent lamp has low power consumption and high brightness, such that it has been widely used at office or at home.

Meanwhile, an illumination apparatus that replaces the fluorescent lamp or the incandescent lamp has been recently developed and, representatively, an illumination apparatus using a light emitting diode (LED) has been introduced.

However, in the case of the illumination apparatus using the LED, it is driven with different voltage from the fluorescent lamp or the incandescent lamp, causing a problem that all of power supply apparatus including conventionally installed sockets should be replaced when using the illumination apparatus using the LED.

SUMMARY OF THE INVENTION

Embodiments of the invention provide an illumination apparatus with a new structure using a LED or an OLED.

Embodiments provide an illumination apparatus using the LED or the OLED that can be used without replacing a power supply apparatus installed for a conventional fluorescent lamp, an incandescent lamp, and a halogen lamp.

Embodiments provide an illumination apparatus that can compatibly use various light emitting device illumination parts by detachably installing an adapter and a light emitting device illumination part.

Embodiments provide an illumination apparatus that can control color, brightness, chroma, and blinking of light emitted from a light emitting device illumination part.

Embodiments provide an illumination apparatus that emits light with various colors by controlling a plurality of light emitting devices that emits red, green, blue, and white light.

An illumination apparatus according to various embodiments includes: an adapter that converts alternating power into driving power, and controls one or more of a color, brightness, chroma, and blinking of one or more light emitting devices; and a light emitting device illumination part that is detachably and electrically connected to the adapter to emit light in accordance with the driving power and control.

An illumination apparatus according to various embodiments includes: an adapter that converts alternating power into driving power; a light emitting device illumination part that is detachably coupled to the adapter and includes a red light emitting device string, a green light emitting device string, a blue light emitting device string, and a white light emitting device string, which emit light in accordance with the driving power from the adapter; and a controller that is connected to the adapter and controls the red light emitting device string, the green light emitting device string, the blue light emitting device string, and the white light emitting device string.

A method of driving an illumination apparatus according to various embodiments includes: converting alternating power into driving power using an adapter; extracting driving pulse information from a memory of the adapter; and controlling light emissions from a light emitting device illumination part detachably and electrically connected to the adapter in accordance with the driving power and driving pulse information.

A method of driving an illumination apparatus according to other embodiments includes: converting alternating power into driving power using an adapter; generating a control signal from a controller connected to the adapter; and emitting light from a red light emitting device string, a green light emitting device string, a blue light emitting device string, and a white light emitting device string of a light emitting device illumination part in accordance with the control signal.

DETAILED DESCRIPTION OF THE EMBODIMENTS

Figure 1:
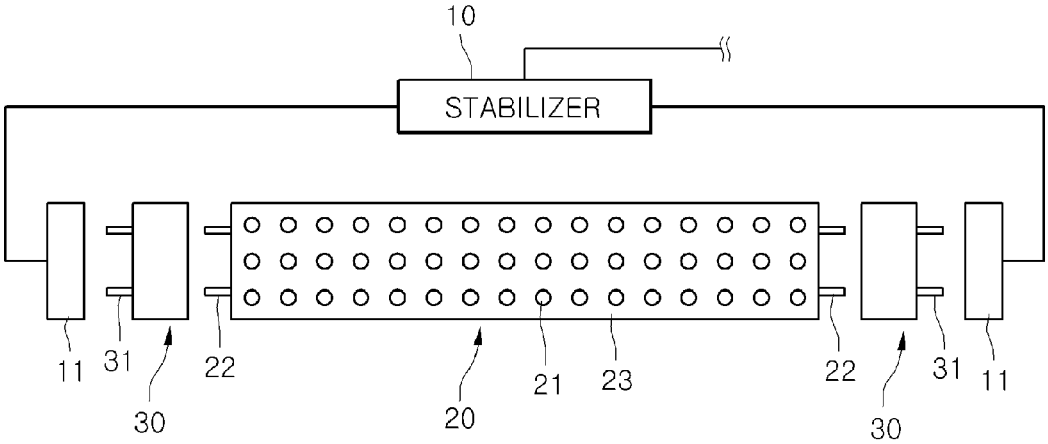
FIG. 1 is a diagram explaining an illumination apparatus according to the first embodiment.

In the drawings, the thickness or size of each layer is exaggerated, omitted or schematically illustrated for the convenience and clarity of explanation. Also, the size of each constituent does not completely reflect its actual size.

Hereinafter, an illumination apparatus according to embodiments will be described in detail with reference to the accompanying drawings.

Figure 2:
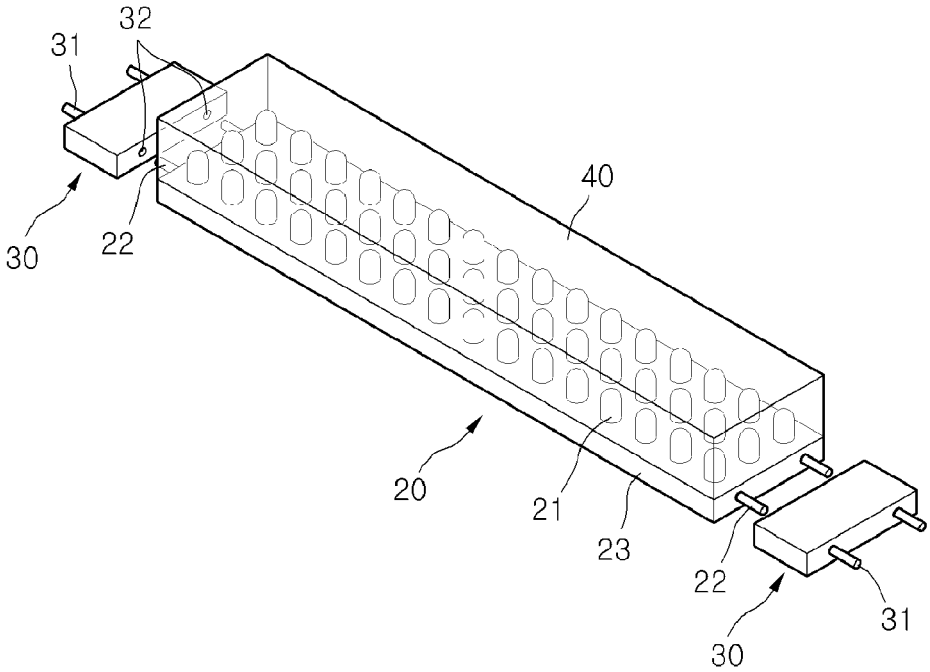
FIG. 2 is a perspective view of the illumination apparatus according to the first embodiment.
Figure 3:
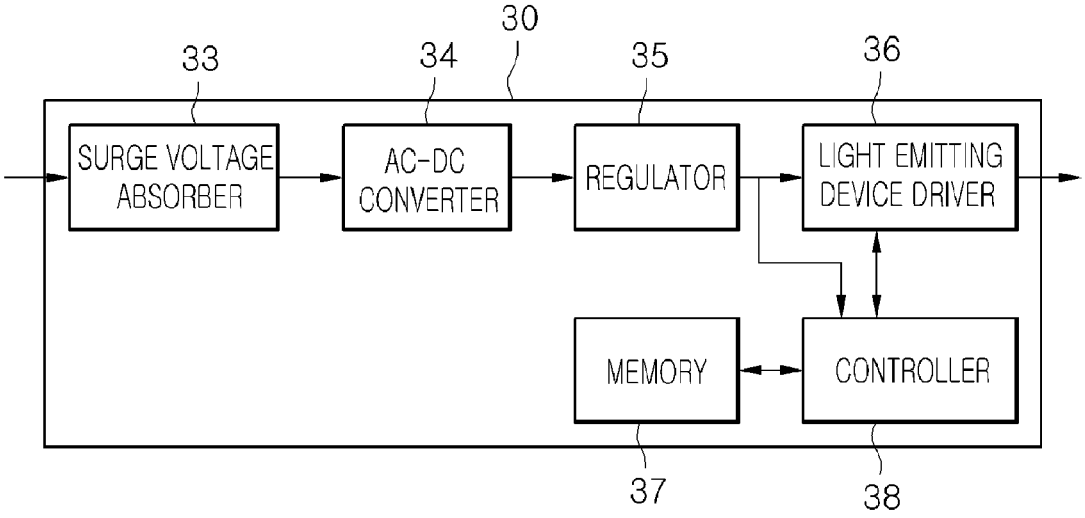
FIG. 3 is a diagram explaining an adapter in the illumination apparatus according to the first embodiment.

FIG. 1 is a diagram explaining an illumination apparatus according to the first embodiment, FIG. 2 is a perspective view of the illumination apparatus according to the first embodiment, and FIG. 3 is a diagram explaining an adapter in the illumination apparatus according to the first embodiment.

First, referring to FIGS. 1 and 2, the illumination apparatus according to the first embodiment includes a power terminal 22 formed at both ends of a substrate 23, a light emitting device illumination part 20 having a plurality of light emitting devices 21 installed on the upper surface of the substrate 23, and an adapter coupled at both sides of the light emitting device illumination part 20. Moreover, a cover 40 that protects the light emitting devices 21 may further be installed on the substrate 23.

In the light emitting device illumination part 20, the plurality of light emitting devices 21 are arranged on the substrate 23. The light emitting devices 21 may comprise light-emitting diodes (LEDs) or organic light-emitting diodes (OLEDs).

The substrate 23 may be a printed circuit board (PCB) on which a circuit pattern for providing power to the light emitting devices 21 is formed. Also, the substrate 23 may include a substrate having wiring for providing power to the light emitting devices 21 installed thereon. In one implementation, the substrate includes a plastic sheet or instrument, which may be stiff (rigid) or flexible.

Moreover, a reflective coating layer (not shown) maybe formed on the surface of the substrate 23, making it possible to increase efficiency of light emitted from the light emitting devices 21 by coating it with silver (Ag) or aluminum (Al).

The plurality of light emitting devices 21 may include LED or OLED that emit red, blue, and green light, and may also include LED or OLED that emit white light.

The cover 40 may be formed of transparent plastic material, and may also be formed of plastic with various colors such as red, green, blue, etc., as needed. Also, the cover 40 may be formed of translucent material and in this case, it may also provide an illumination with a soft atmosphere.

Power terminals 22 that can be electrically connected to the adapter 30 is installed at both ends of the substrate 23, thereby supplying power to the light emitting devices 21 from the outside.

The adapter 30 includes a connection terminal 31 formed at one side and inserted into a socket 11 that install a conventional fluorescent lamp, and a power terminal groove 32 formed at the other side and into which the power terminal 22 of the light emitting device illumination part 20 is inserted.

The light emitting device illumination part 20 is coupled to the adapter 30 so that the illumination apparatus according to the first embodiment can be installed at the socket 11 where a conventional fluorescent lamp is installed. Therefore, although a power supply apparatus including the socket 11 where the conventional fluorescent lamp is installed is not replaced, an illumination apparatus using LED or OLED can be used.

In particular, since the light emitting device illumination part 20 and the adapter 30 are detachably installed, when defects are generated on the light emitting device illumination part 20 or the adapter 30, only the light emitting device illumination part 20 or the adapter 30 where the defects are generated can be replaced, having low maintenance costs.

Moreover, since the light emitting device illumination part 20 and the adapter 30 are detachably installed, illuminations with various atmospheres can be provided by replacing only the light emitting device illumination part 20.

Referring to FIG. 3, the adapter 30 includes a surge voltage absorber 33, an AC-DC converter 34, a regulator 35, a light emitting device driver 36, a memory 37, and a controller 38.

Figure 4:
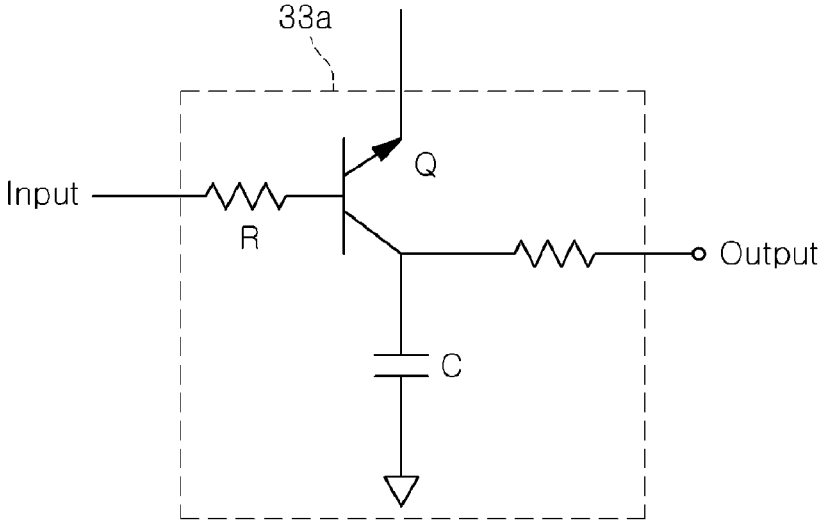
FIG. 4 is a diagram showing a surge voltage absorber in the illumination apparatus according to the first embodiment

The surge voltage absorber 33 is installed to absorb surge voltage when the surge voltage to turn on a fluorescent lamp is applied from a stabilizer 10, and, for example, it may include a surge voltage absorption circuit 33*a* as shown in FIG. 4.

Figure 5:
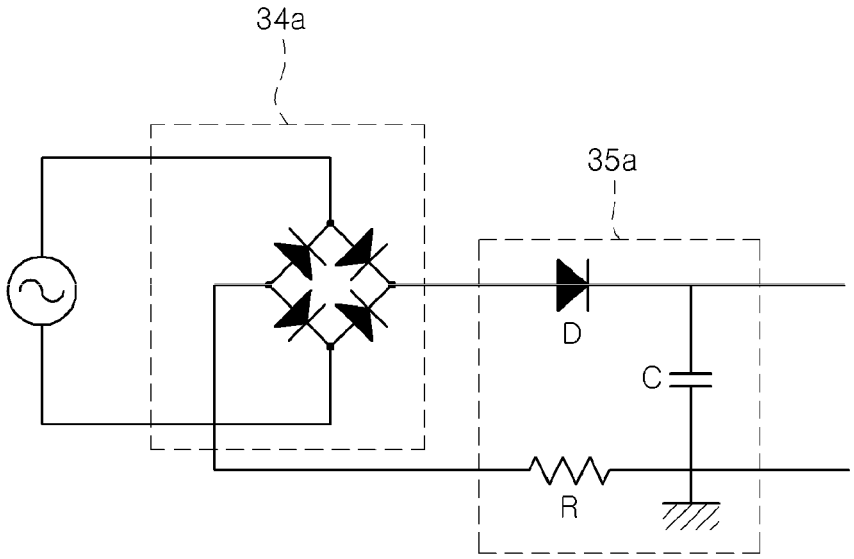
FIG. 5 is a diagram showing the AC-DC converter in the illumination apparatus according to the first embodiment.

The AC-DC converter 34 converts the AC power supplied through the socket 11 into DC power, and the regulator 35 allows the DC power output from the AC-DC converter 34 to be output as constant DC voltage. For example, as shown in FIG. 5, the AC-DC converter 34 and the regulator 35 may include a bridge rectifier 34*a* and a smoothing circuit 35*a*.

The light emitting device driver 36 outputs the DC voltage supplied from the regulator 35 as driving pulse that is proper in driving the plurality of light emitting devices 21.

Figure 6:
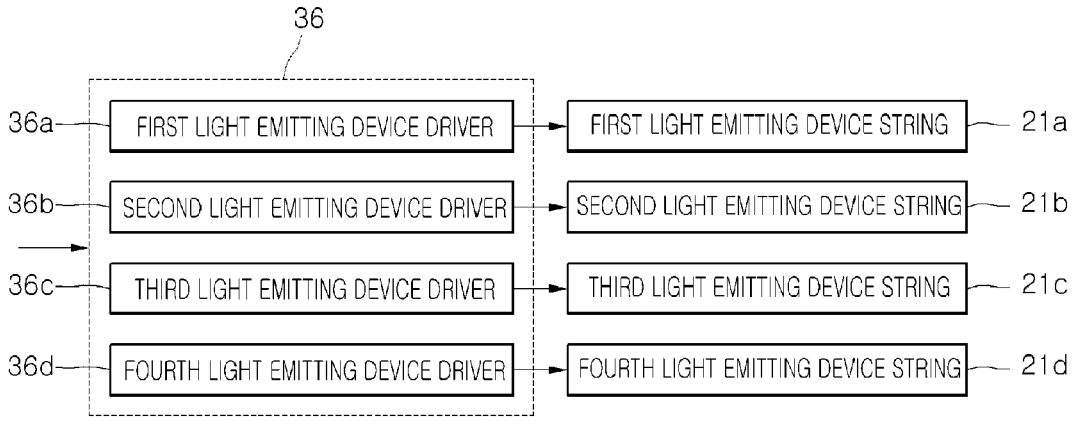
FIG. 6 is a diagram illustrating an example of an LED driver in the illumination apparatus according to the first embodiment.

Referring to FIG. 6, the light emitting device driver 36 includes a first light emitting device driver 36*a*, a second light emitting device driver 36*b*, a third light emitting device driver 36*c*, and a fourth light emitting device driver 36*d*, wherein the first light emitting device driver 36*a*, the second light emitting device driver 36*b*, the third light emitting device driver 36*c*, and the fourth light emitting device driver 36*d* drive a first light emitting device string 21*a*, a second light emitting device string 21*b*, a third light emitting device string 21*c*, and a fourth light emitting device string 21*d* formed in the light emitting device illumination part 20, respectively.

For example, the first light emitting device string 21*a* may be formed by connecting a plurality of LED or OLED that emit red light in series, the second light emitting device string 21*b* may be formed by connecting a plurality of LED or OLED that emit green light in series, the third light emitting device string 21*c* may be formed by connecting a plurality of LED or OLED that emit blue light in series, and the fourth light emitting device string 21*d* may be formed by connecting a plurality of LED or OLED that emit white light in series.

The light emitting device driver 36 controls the first light emitting device driver 36*a*, the second light emitting device driver 36*b*, the third light emitting device driver 36*c*, and the fourth light emitting device driver 36*d* to control the length, interval, etc. of the driving pulses of the first light emitting device string 21*a*, the second light emitting device string 21*b*, the third light emitting device string 21*c*, and the fourth light emitting device string 21*d*, allowing various colors of light to be emitted.

For example, if the driving pulse is applied to only the first light emitting device string 21*a* by driving only the first light emitting device driver 36*a*, red light is emitted from the light emitting device illumination part 20.

Moreover, if the driving pulse is applied to only the fourth light emitting device string 21*d* by driving only the fourth light emitting device driver 36*d*, white light is emitted from the light emitting device illumination part 20. Also, if the driving pulse is applied to the first light emitting device string 21*a*, the second light emitting device string 21*b*, the third light emitting device string 21*c*, and the fourth light emitting device string 21*d* by driving the first light emitting device driver 36*a*, the second light emitting device driver 36*b*, the third light emitting device driver 36*c*, and the fourth light emitting device driver 36*d*, brighter white light is emitted from the light emitting device illumination part 20.

The memory 37 stores information for driving the plurality of light emitting devices 21. For example, the memory 37 can store driving pulse information output from the first light emitting device driver 36*a*, the second light emitting device driver 36*b*, the third light emitting device driver 36*c*, and the fourth light emitting device driver 36*d*.

The controller 38 extracts the driving pulse information stored in the memory 37 and controls the first light emitting device driver 36*a*, the second light emitting device driver 36*b*, the third light emitting device driver 36*c*, and the fourth light emitting device driver 36*d* to drive the first light emitting device string 21*a*, the second light emitting device string 21*b*, the third light emitting device string 21*c*, and the fourth light emitting device string 21*d*.

For example, the controller 38 can control the color, brightness, chroma, and blinking of the light emitted from the plurality of light emitting devices 21, by providing different driving pulse information to the first light emitting device driver 36*a*, the second light emitting device driver 36*b*, the third light emitting device driver 36*c*, and the fourth light emitting device driver 36*d*.

Therefore, the illumination apparatus according to the first embodiment can also be used in the power supply apparatus for the conventional fluorescent lamp to which the AC power is supplied by the adapter 30 that includes the surge voltage absorber 33, the AC-DC converter 34, the regulator 35, and the light emitting device driver 36.

In other words, as shown in FIG. 1, the power supply apparatus for the fluorescent lamp includes a stabilizer 10 that converts commercial power into high frequency current of 20-50 kHz and first and second sockets 11 and 12 connected to the stabilizer 10, wherein only high frequency AC current is provided through the socket 11, such that the light emitting device illumination part 20 cannot be installed directly on the conventional power supply apparatus.

However, the illumination apparatus according to the first embodiment installs the adapter 30, making it possible to use the light emitting device illumination part 20, while using the conventional power supply apparatus as it is.

Further, the illumination apparatus according to the first embodiment can variously control color, brightness, chroma, and blinking of light emitted from the light emitting illumination part 20, using the adapter 30 including the memory 37, the controller 38, and the light emitting device driver 36.

Moreover, since the adapter 30 and the light emitting device illumination part 20 are detachable, the illumination apparatus can be used to be connected to only the light emitting device illumination part 20 by separating the adapter 30 from the light emitting device illumination part 20 where the power supply apparatus for the light emitting device illumination part 20 is installed.

Figure 7:
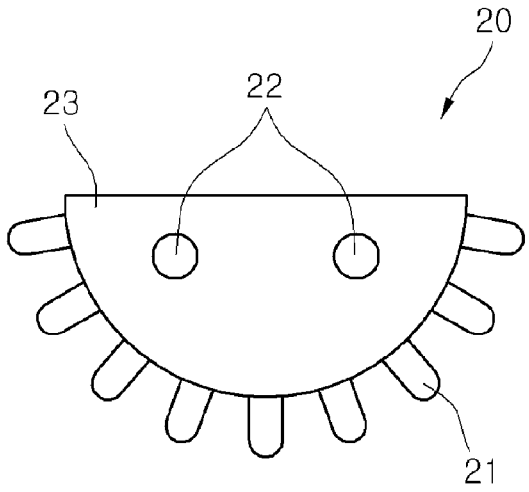
FIGS. 7 to 9 are views illustrating another example of the illumination apparatus according to the first embodiment.
Figure 8:
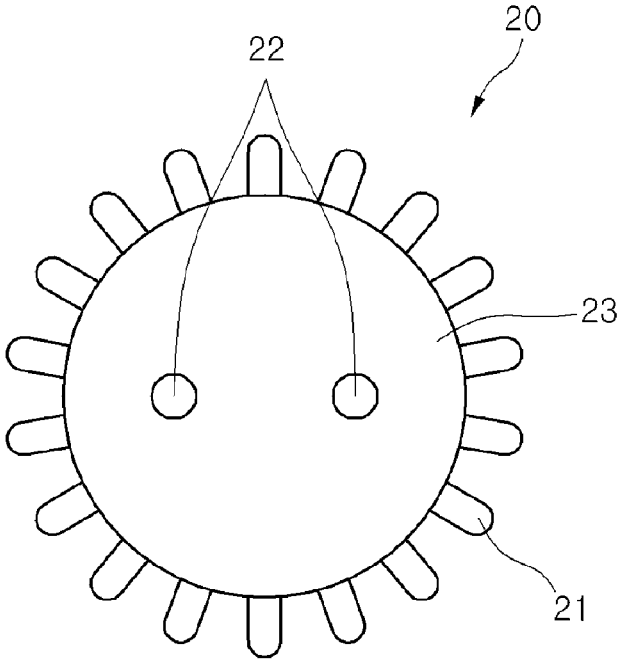
Figure 9:
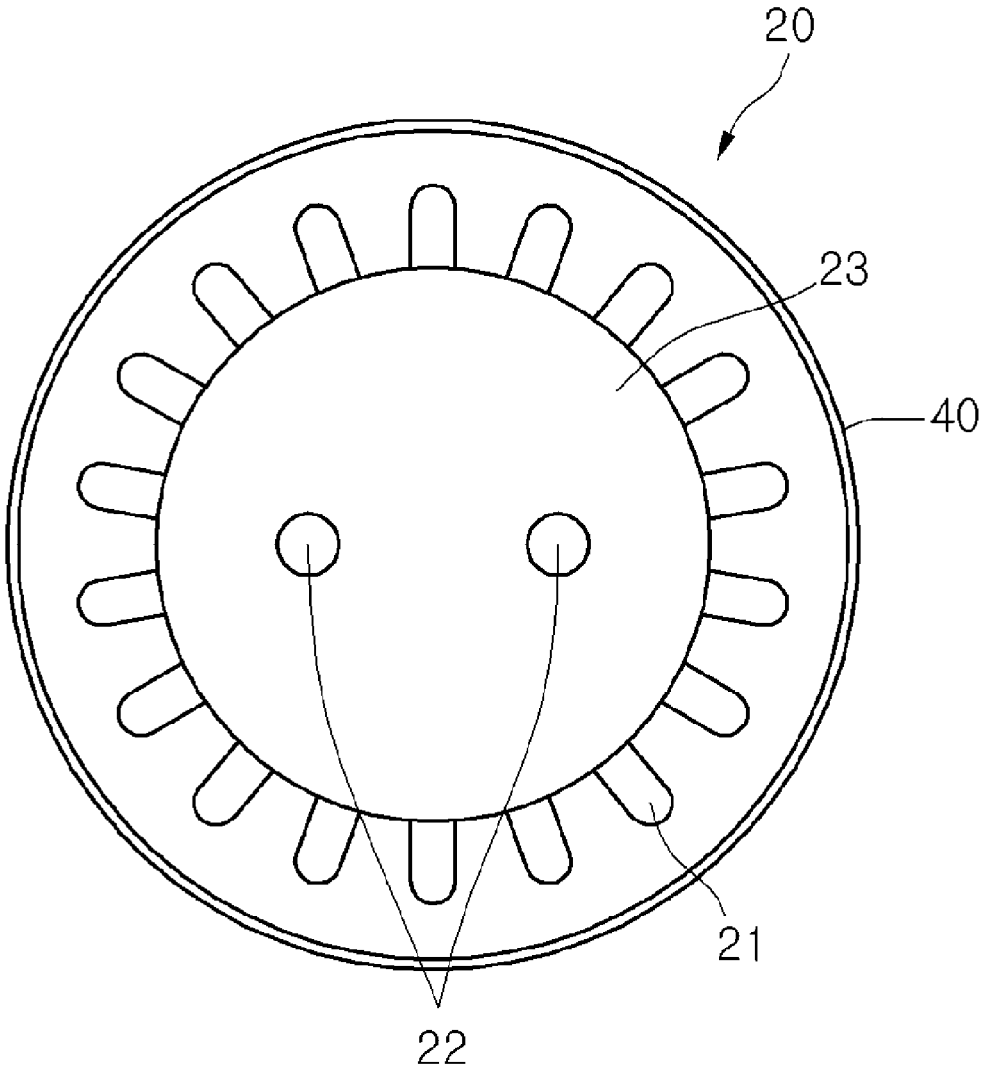

FIGS. 7 to 9 are diagrams explaining another example of the light emitting device illumination part in the illumination apparatus according to the first embodiment. FIGS. 7 to 9 are side views of the light emitting device illumination part seen from the direction where the adapter is disposed.

Referring to FIG. 7, a light emitting device illumination part 20 includes a substrate 23 whose cross-section is formed in a semicircular shape and a plurality of light emitting devices 21 installed at the semicircle-shaped surface of the substrate 23, wherein a power terminal 22 is installed at ends of the substrate 23.

In FIG. 7, the substrate 23 is formed in a semicircular shape and the light emitting devices 21 are installed at the curved part, such that the light emitting device illumination part 20 is proper in being used in an environment where it is effective to provide illumination only downward. For example, when the light emitting device illumination part 20 is installed at a ceiling or the like, light efficiency can be increased.

Referring to FIG. 6, a light emitting device illumination part 20 includes a substrate 23 whose cross-section is formed in a circular shape and a plurality of light emitting devices 21 installed at the circular-shaped surface of the substrate 23, wherein a power terminal 22 is installed at both ends of the substrate 23.

In FIG. 8, the substrate 23 is formed in a circular shape and the light emitting devices 21 are installed at the curved part, such that the light emitting device illumination part 20 is proper in being used in an environment where it is effective to provide illumination in 360° directions. For example, when the light emitting device illumination part 20 is installed at an advertisement facility in a cylindrical shape, light efficiency can be increase. The light emitting device illumination part 20 as shown in FIG. 8 may also be used as home illumination of office illumination.

Referring to FIG. 9, a light emitting device illumination part 20 includes a substrate 23 whose cross-section is formed in a circular shape and a plurality of light emitting devices 21 installed at the circular-shaped surface of the substrate 23, wherein a first power terminal 22 is installed at ends of the substrate 23. Also, a cover that protects the light emitting devices 21 is further included.

The cover 40 is installed to be spaced from the light emitting devices 21 at a predetermined interval, making it possible to protect the light emitting devices 21 from external impact or environmental change. The cover 40 may also be formed of transparent or translucent plastic material.

Figure 10:
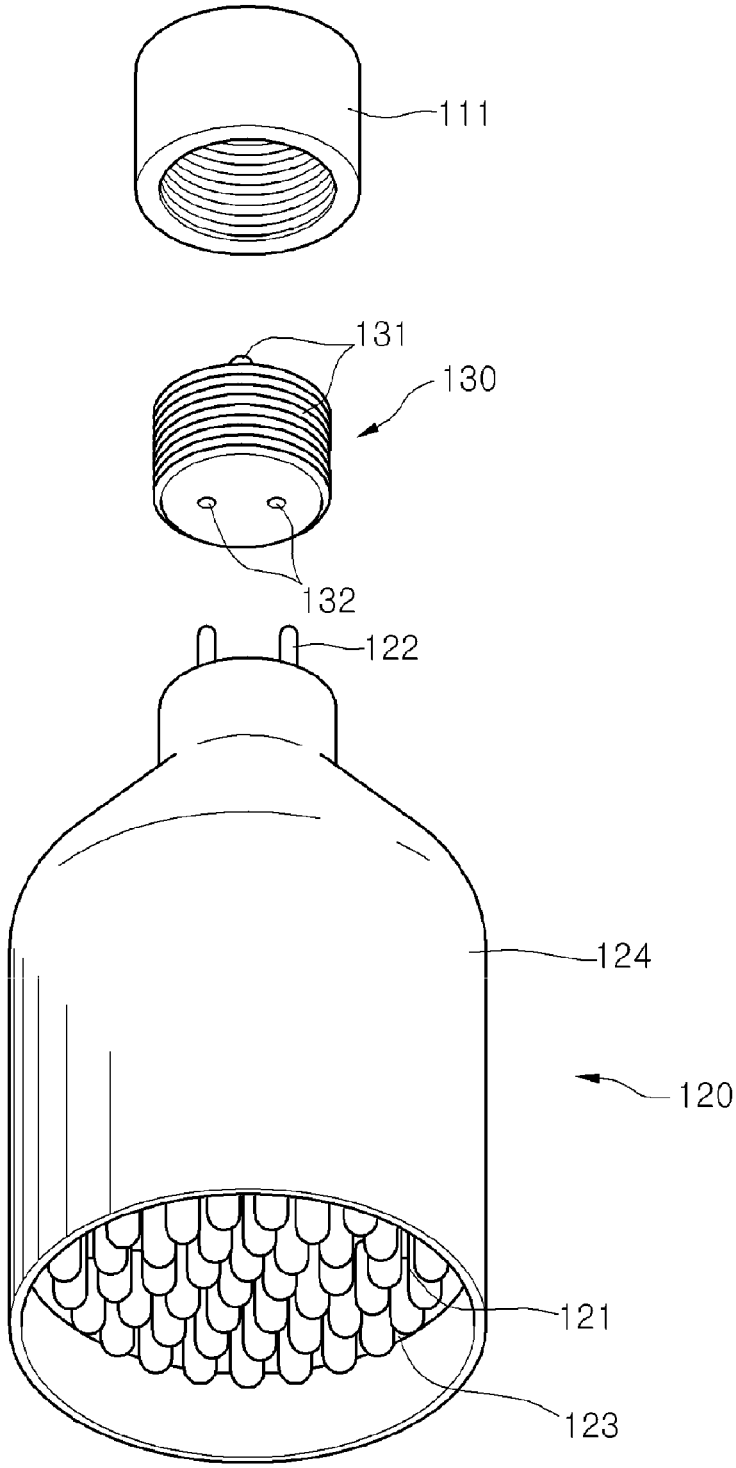
FIG. 10 is a view illustrating an illumination apparatus according to a second embodiment.
Figure 11:
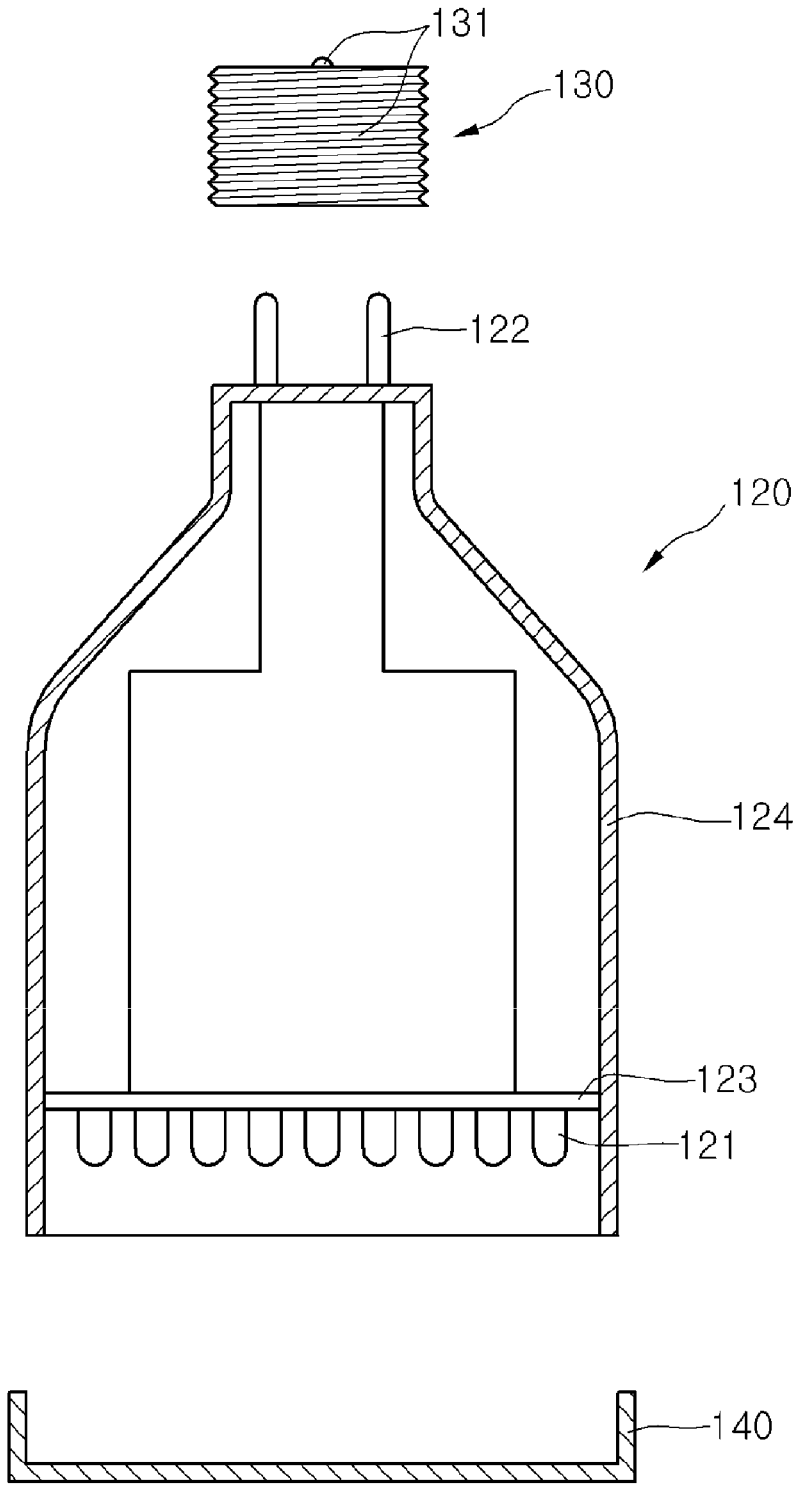
FIG. 11 is a cross-sectional view of an illumination apparatus according to a second embodiment.
Figure 12:
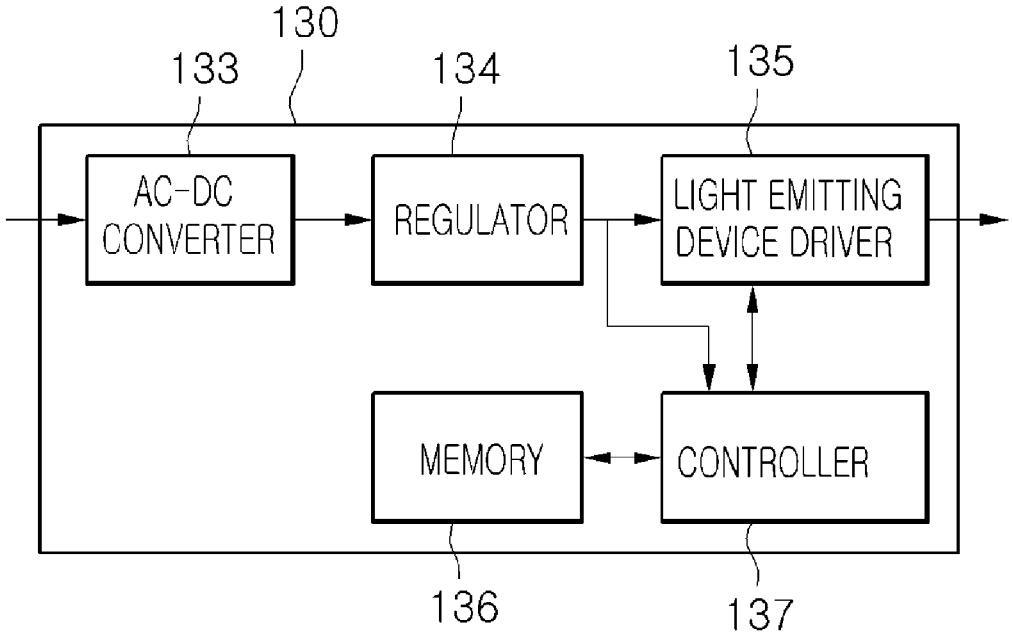
FIG. 12 is a diagram illustrating an adapter in the illumination apparatus according to the second embodiment.

FIG. 10 is a diagram explaining an illumination apparatus according to a second embodiment, FIG. 11 is a cross-sectional view of the illumination apparatus according to the second embodiment, and FIG. 12 is a diagram explaining an adapter in the illumination apparatus according to the second embodiment.

First, referring to FIGS. 10 and 11, the illumination apparatus according to the second embodiment includes an adapter 130 that can be coupled to a socket 111 where an incandescent lamp or a halogen lamp can be installed, and a light emitting device illumination part 120 that is detachably coupled to the adapter 130.

The adapter 130 has a spiral protrusion to be coupled to the socket 111, and a connection terminal 131 electrically connected with the socket 111 and a power terminal groove 132 where the light emitting device illumination part 120 to be electrically connected thereto.

The light emitting device illumination part 120 includes a power terminal 122 that is inserted in the power terminal groove 132 to be electrically connected, a housing 124 where the power terminal 122 is installed, a substrate 123 coupled to the housing 124, and a plurality of light emitting devices 121 installed on the substrate 123. Further, a cover 140 that is coupled with the housing 124 may be further included to protect the plurality of light emitting devices 121.

The substrate 123 may be a printed circuit board (PCB) on which a circuit pattern for providing power to the light emitting devices 121 is formed. Also, the substrate 123 may be a substrate that a wiring for providing power to the light emitting devices 121 is installed on a plastic instrument. The substrate 123 is electrically connected with the power terminal 122.

Moreover, a reflective coating layer (not shown) may be formed on the surface of the substrate 123, making it possible to increase efficiency of light emitted from the light emitting devices 121 by coating it with silver (Ag) or aluminum (Al).

The substrate 123 is formed in a plate shape and inserted in the housing 124 in the second embodiment. Therefore, when the cover 140 is coupled to the housing 124, the light emitting devices 121 are disposed to be surrounded by the housing 124 and the cover 140.

The plurality of light emitting devices 121 may include LEDs or OLEDs that emit red, blue, or green light, and may also include LEDs or OLEDs that emit white light.

The cover 140 may be formed of transparent plastic material, and may also be formed of plastic with various colors such as red, green, blue, etc., depending on design. Also, the cover 140 may be formed of translucent material and in this case, it may also provide an illumination with a soft atmosphere.

The light emitting device illumination part 120 is coupled to the adapter 130 so that the illumination apparatus according to the second embodiment can be installed at the socket 111 where conventional incandescent lamp and fluorescent lamp are installed.

Moreover, the illumination apparatus according to the second embodiment can drive the light emitting devices 121, using the adapter 130 converting the AC power applied to a conventional incandescent lamp or a halogen lamp into DC power.

Therefore, although a power supply apparatus including the socket 111 where the conventional incandescent lamp or the fluorescent lamp are installed is not replaced, an illumination apparatus using LED or OLED can be used.

In particular, the light emitting device illumination part 120 and the adapter 130 are installed detachably so that when defects are generated in the light emitting device illumination part 120 or the adapter 130, only the light emitting device illumination part 120 or the adapter 130 where the defects are generated can be replaced, having low maintenance costs.

Moreover, the light emitting device illumination part 120 and the adapter 130 are detachably installed so that illuminations with various atmospheres can be provided by replacing only the light emitting device illumination part 120.

Referring to FIG. 12, the adapter 130 includes an AC-DC converter 133, a regulator 134, a light emitting device driver 135, a memory, and a controller 137.

The AC-DC converter 133 converts the AC power supplied through the socket 111 into DC power, and the regulator 134 allows the DC power output from the AC-DC converter 133 to be output as constant DC voltage. For example, the AC-DC converter 133 and the regulator 134, as described in relation to FIG. 5, can constant DC voltage to be output by a bridge rectifier 34*a* and a smoothing circuit 35*a*.

The light emitting device driver 135 outputs the DC voltage supplied from the regulator 134 as driving pulse that is proper in driving the plurality of light emitting devices 121.

The light emitting device driver 135, as described with reference to FIG. 6, includes the first light emitting device driver, the second light emitting device driver, the third light emitting device driver, and the fourth light emitting device driver, wherein the first light emitting device driver, the second light emitting device driver, the third light emitting device driver, and the fourth light emitting device driver drive a first light emitting device string, a second light emitting device string, a third light emitting device string, and a fourth light emitting device string installed in the light emitting device illumination part 120, respectively.

The operation of the light emitting device driver 135 is the same as that of the light emitting device driver 36 of the first embodiment, such that repeated description is not provided.

The memory 136 stores information for driving the plurality of light emitting devices 121. For example, the memory 136 can store driving pulse information output from a first light emitting device driver, a second light emitting device driver, a third light emitting device driver, and a fourth light emitting device driver of the light emitting device driver 135.

The controller 137 extracts the driving pulse information stored in the memory 136 and controls the first light emitting device driver, the second light emitting device driver, the third light emitting device driver, and the fourth light emitting device driver to drive the first light emitting device string, the second light emitting device string, the third light emitting device string, and the fourth light emitting device string.

For example, the controller 137 can control the color, brightness, chroma, and blinking of the light emitted from the plurality of light emitting devices 121, by providing different driving pulse information to the first light emitting device driver, the second light emitting device driver, the third light emitting device driver, and the fourth light emitting device driver.

Therefore, the illumination apparatus according to the second embodiment can also be used in the power supply apparatus for a conventional incandescent lamp and a halogen fluorescent lamp to which the AC power is supplied by the adapter 130 that includes the AC-DC converter 133, the regulator 134, and the light emitting device driver 135.

Further, the illumination apparatus according to the second embodiment can variously control color, brightness, chroma, and blinking of light emitted from the light emitting illumination part 120, using the adapter 130 including the memory 136, the controller 137, and the light emitting device driver 135.

Moreover, since the adapter 130 and the light emitting device illumination part 120 are detachable, the illumination apparatus can be used to be connected to only the light emitting device illumination part 120 by separating the adapter 130 from the light emitting device illumination part 20 where the power supply apparatus for the light emitting device illumination part 120 is installed.

Figure 13:
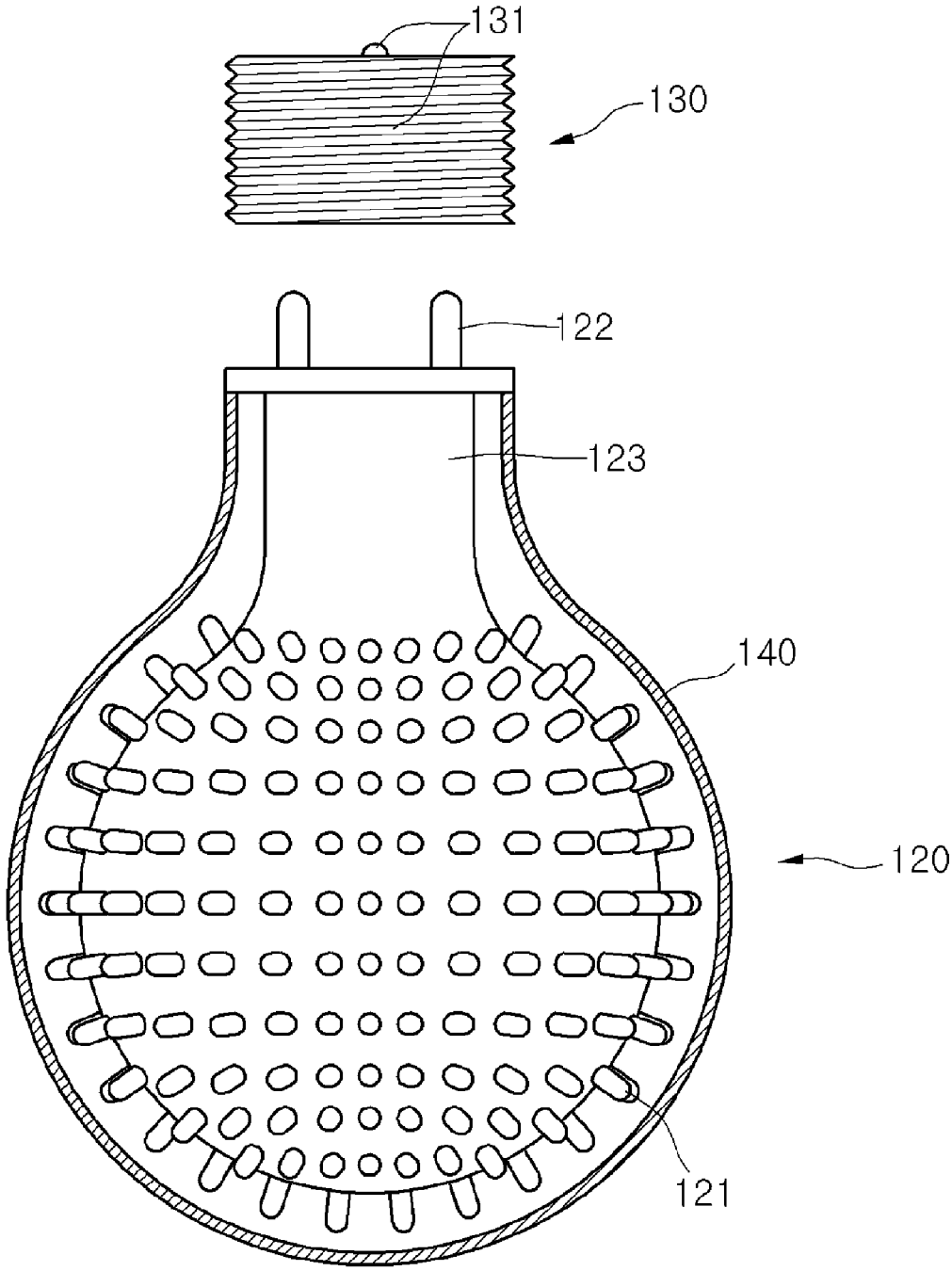
FIG. 13 is a view illustrating another example of the illumination apparatus according the second embodiment.

FIG. 13 is a view illustrating another example of the illumination apparatus according the second embodiment.

In describing the illumination apparatus shown in FIG. 13, repeated portions with those described with reference to FIGS. 10 and 11 are not described.

Referring to FIG. 13, a light emitting device illumination part 120 includes a spherical substrate 123 and a plurality of light emitting devices 121 installed on the surface of the substrate 123, and a power terminal 122 is installed at one side of the substrate 123. Further, a cover 140 that surrounds the substrate 123 and is spaced apart at a predetermined distance from the light emitting devices 121 may be further included.

Since the plurality of light emitting devices 121 is installed on the spherical substrate 123, the light emitting device illumination part 120 can provide illumination with a large angle.

Embodiments of the invention can provide an illumination apparatus with a new structure using LED or OLED.

Embodiments can provide an illumination apparatus using the LED or the OLED without replacing the conventional power supply apparatus installed for the fluorescent lamp.

Embodiments can provide an illumination apparatus that can compatibly use various light emitting device illumination parts by detachably installing the adapter and the light emitting device illumination part.

Embodiments can provide an illumination apparatus that can control color, brightness, chroma, and blinking of light emitted from the light emitting device illumination part.

Embodiments can provide an illumination apparatus that emits light with various colors by controlling a plurality of light emitting devices that emit red, green, blue, and white light.

Any reference in this specification to "one embodiment," "an embodiment," "example embodiment," etc., means that a particular feature, structure, or characteristic described in connection with embodiments is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An illumination apparatus comprising:

an adapter that converts alternating power into driving power, includes a memory that stores information on a driving pulse applied to one or more light emitting devices, extracts the driving pulse information from the memory and controls one or more of the color, brightness, chroma, and blinking of the one or more light emitting devices therewith; and a light emitting device illumination part detachably and electrically connected to the adapter, containing the one or more light emitting devices configured to emit light in accordance with the driving power and control.

2. The illumination apparatus according to claim 1, wherein the adapter includes:

an AC-DC converter that converts AC voltage into DC voltage;

a regulator that receives the DC voltage from the AC-DC converter and outputs a constant DC voltage; and a light emitting device driver that receives the constant DC voltage from the regulator and outputs a driving pulse.

3. The illumination apparatus according to claim 2, wherein the adapter further includes a surge voltage absorber that absorbs a surge voltage.

4. The illumination apparatus according to claim 1, wherein the light emitting device illumination part includes a plurality of light emitting device strings, each comprising a separate plurality of light emitting devices, and the adapter includes a plurality of light emitting device drivers, each separately controlling one of the plurality of light emitting device strings.

5. The illumination apparatus according to claim 1, wherein the light emitting device comprises a light-emitting diode (LED) or an organic light-emitting diode (OLED).

6. The illumination apparatus according to claim 1, wherein the adapter is configured to be inserted into a fluorescent socket having a stabilizer.

7. The illumination apparatus according to claim 1, wherein the adapter is configured to be inserted into an incandescent lamp socket or a halogen lamp socket.

8. An illumination apparatus comprising:

an adapter that converts alternating power into driving power, wherein the adapter includes a memory that stores driving pulse information on one or more driving pulses applied to the plurality of light emitting devices;

a light emitting device illumination part that is detachably coupled to the adapter and includes a red light emitting device string, a green light emitting device string, a blue light emitting device string, and a white light emitting device string, which emit light in accordance with the driving power from the adapter; and a controller connected to the adapter and that controls the red light emitting device string, the green light emitting device string, the blue light emitting device string, and the white light emitting device string, wherein the controller extracts the driving pulse information from the memory and controls the plurality of light emitting devices according to the driving pulse information.

9. A method of driving an illumination apparatus, comprising:

converting alternating power into driving power using an adapter;

extracting driving pulse information from a memory of the adapter; and controlling light emissions from a light emitting device illumination part detachably and electrically connected with the adapter in accordance with the driving power and the driving pulse information.

10. The method according to claim 9, wherein each of a plurality of light emitting device drivers control a light emitting device string of the light emitting device illumination part.

11. A method of driving an illumination apparatus, comprising:

converting alternating power into driving power by an adapter;

generating a control signal from a controller connected to the adapter;

extracting driving pulse information from a memory with the controller; and emitting light from a red light emitting device string, a green light emitting device string, a blue light emitting device string, and a white light emitting device string in accordance with the control signal and the driving pulse information.

12. The method according to claim 9, wherein the driving pulse information from the memory controls one or more of the color, brightness, chroma, and blinking of the light emitting device illumination part.

* * * * *